United States Patent [19]

Breuer et al.

[11] 4,179,161

[45] Dec. 18, 1979

[54] PLOUGH FOR WINNING MATERIAL FROM A MINERAL FACE

[75] Inventors: Oswald Breuer, Dortmund-Husen; Bernd Steinkuhl, Lunen, both of Fed. Rep. of Germany

[73] Assignee: Gewerkschaft Eisenhutte Westfalia, Lunen, Fed. Rep. of Germany

[21] Appl. No.: 883,931

[22] Filed: Mar. 6, 1978

[30] Foreign Application Priority Data

Mar. 4, 1977 [DE] Fed. Rep. of Germany ..... 2709392

[51] Int. Cl.[2] ..... E21C 27/34

[52] U.S. Cl. ..... 299/34; 299/80

[58] Field of Search ..... 299/34, 32

[56] References Cited

U.S. PATENT DOCUMENTS 2,561,642 7/1951 Vogel ..... 299/32

FOREIGN PATENT DOCUMENTS 2309820 8/1974 Fed. Rep. of Germany ..... 299/34

2319125 10/1974 Fed. Rep. of Germany ..... 299/34

2607100 8/1977 Fed. Rep. of Germany ..... 299/34

*Primary Examiner*—Ernest R. Purser

*Attorney, Agent, or Firm*—Neil F. Markva

[57] ABSTRACT

A plough for winning material from a mineral face comprises two plough bodies connected together in a tension-proof manner. The two plough bodies are provided with detachable cutters at each end thereof. A rigid beam, also provided with detachable cutters, connects the two plough bodies at a predetermined height. The beam carries a plough upper part for each of the two plough bodies. Each plough upper part is provided with detachable cutters and is pivotably mounted on the beam by means of a parallelogram linkage. Each plough upper part is guided and supported on the beam by means of a keyed connection.

35 Claims, 5 Drawing Figures

PLOUGH FOR WINNING MATERIAL FROM A MINERAL FACE

BACKGROUND OF THE INVENTION

This invention relates to a plough for winning a mineral from a mineral face or seam in a mine working. The invention is particularly, but not solely, concerned with a plough for use in mining coal.

Various coal ploughs are known which can win coal over the entire thickness of a coal seam. Such ploughs are also adaptable to variations in seam thickness. For example, Dt-Gb No. 1,990,314 describes a coal plough having two interconnected plough bodies which are provided with cutters and which are guided on a plough guide. The two plough bodies are connected together in a tension-proof manner by means of a beam pivotally connected to both bodies. Further cutters are provided on carriers which are pivotally mounted on the beam. Each such carrier is mounted on the beam by means of a parallelogram linkage so that it can be pivoted out and upwards towards the roof above the cutting height of the cutters provided on the plough bodies themselves. Thus, it is possible to win the entire thickness of a seam even where the seam varies in thickness. The carriers are pivoted out to bring their cutters into use by means of pressurized gas rams connected to a common compressed gas reservoir. Each ram is interposed, approximately in an upright position, between the beam and the lower link of the corresponding parallelogram linkage.

It is also known (see Dt-As 1,238,418) to equip coal ploughs with hydraulically extensible cutters or cutter carriers. In this case, the cutters or carriers are extended by means of hydraulic rams supplied, for example, with pressurized hydraulic fluid from hydraulic accumulators attached to the plough.

The aim of the invention to provide a plough, having two plough bodies interconnected by a rigid beam, which will have a great range of adjustment of its working height, which is of robust construction, and whose beam can be placed so high thaat at least a part of the material won by the plough can be loaded onto a conveyor through the space beneath the beam.

SUMMARY OF THE INVENTION

The present invention provides a plough for winning material from a mineral face, the plough comprising two plough bodies connected together in a tension proof manner. A beam is connected to the two plough bodies at a predetermined height and includes at least one plough upper part which is vertically pivotable relative thereto by means of a linkage. Each plough upper part is guided and supported on the beam by means of a keyed connection.

Preferably, each keyed connection is constituted by a substantially vertical key on the corresponding plough upper part and by a mating slot formed in the beam. Advantageously, the linkage of each plough upper part is constituted by upper and lower parallel links each of which is pivotably connected at one end thereof to plough upper part and at the other end there to the beam by means of pivot joints. Since each plough upper part is supported positively by its keyed connection on both sides, the corresponding linkage and its pivot joints on the beam and on the corresponding plough upper part are shielded from transverse and bending forces which are, dangerous in plough operation. Thus, the linkages can be relatively long without the establishment of excessively high stresses on them. The support and guidance of each plough upper part takes place in the vicinity of its cutters whereby these are kept reliably in engagement with the working face.

By suitable choice of the height of the beam, material won by the plough upper part or parts can be loaded onto a conveyor after passing underneath the beam.

Preferably, a respective hydraulic ram is arranged in an oblique position between the upper link of each linkage and the beam. Advantageously, each hydraulic ram is supported on the beam in the vicinity of the pivot joint connecting the respective lower link to the beam, and approximately in the central region of the beam. This measure renders it possible to use hydraulic rams having a relatively long working stroke even if the beam has only a relatively small height and lies with its lower edge approximately at the upper level of the plough bodies.

Advantageously, each plough body includes detachable cutters at each end thereof, each plough upper part has detachable cutters, and each end of the beam includes detachable cutters. The linkage of each plough upper part can be made such that the cutters of that plough upper part can be pivoted so as to lie above the cutters of the beam. Thus, even a thick seam can be won over its entire height by using the detachable cutters arranged on the plough bodies, the beam and the plough upper part or parts.

Preferably, each plough upper part includes a further plough superstructure which is vertically adjustable relative to that upper plough part. While the pivoting of each plough upper part preferably takes place by means of one or more hydraulic rams, each further plough superstructure may be vertically adjustable relative to its plough upper part by means of a ratchet adjustment device. A respective locking device may releasably lock each plough upper part and/or each plough superstructure at a given height setting. A push-in bolt may constitute such a locking device. The use of such a mechanical locking arrangement is especially convenient if hydraulic rams are provided for the height adjustment.

The positive guidance and support of the plough upper part(s) on the beam are favored by the arrangement of the vertically adjustable further plough superstructure(s), which may be provided with detachable cutters working in the roof zone. The reaction forces of these cutters are transmitted through the respective plough upper part and its positive guide to the rigid beam of the plough.

In order to obtain a maximum possible range of adjustment, it is advisable to make the linkage of each plough upper part such that the cutters of that plough upper part can be pivoted so as to lie substantially at the same level as the cutters provided on the beam, and for each further plough superstructure to be vertically adjustable so that its cutters lie substantially at the same level as the cutters of the corresponding plough upper part.

Preferably, each end of the beam includes a respective plough upper part which is vertically pivotable relative thereto by means of a respective linkage, and wherein the two plough upper parts are vertically pivotable independently of one another.

Advantageously, the beam includes a hydraulically actuated device for supplying pressurized hydraulic fluid to each hydraulic ram. The actuation of the hydraulically actuated device may be effected by hand. On the other hand, however, the plough can be provided with its own energy source for powering the pivotal movement of each plough upper part, and/or of the plough superstructure or superstructures. In this case a remotely operated pivot device, actuated for example by radio control, can also be provided for the plough upper part or parts.

BRIEF DESCRIPTION OF THE DRAWINGS

One form of coal plough constructed in accordance with the invention will now be described, by way of example, with reference to the accompanying drawings, in which.

DESCRIPTION OF PREFERRED EMBODIMENT

Figure 1:
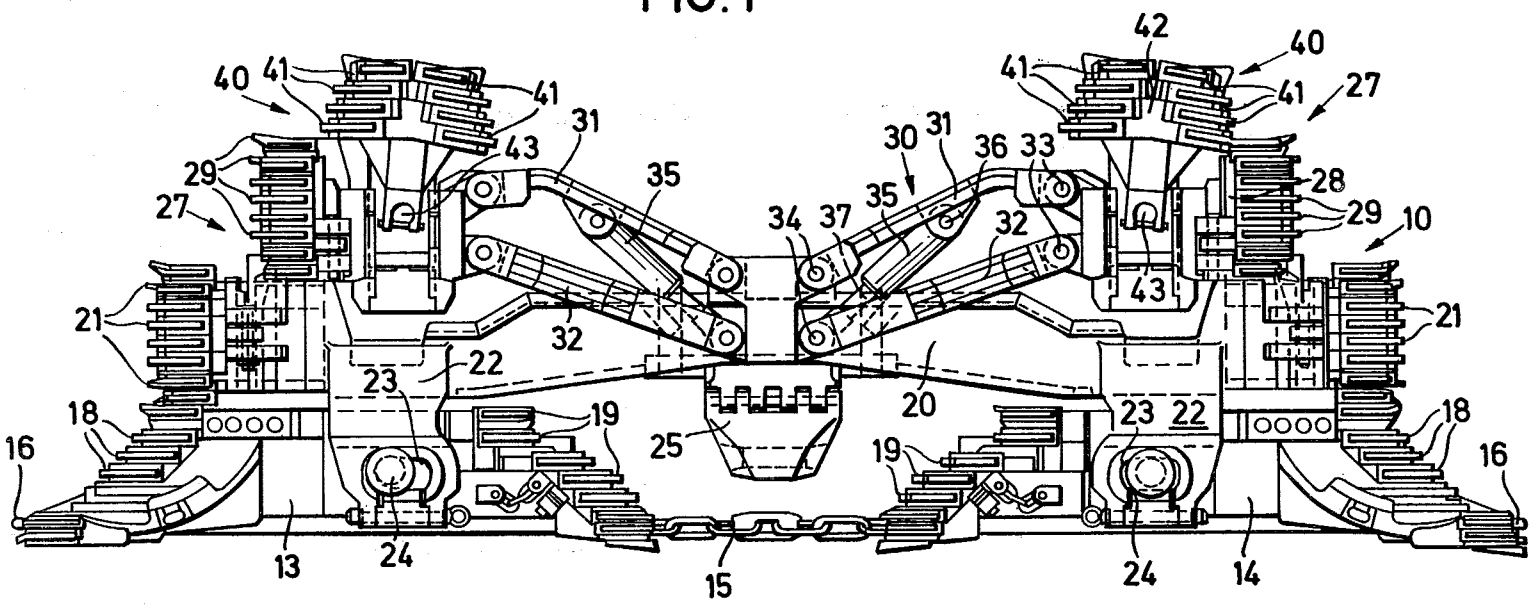
FIG. 1 is a side elevation of the plough as seen from the coal face.

Referring to the drawings, a coal plough 10 is guided on a ramp guide 11 (see FIG. 2) which is built on to the face side of a scraper chain conveyor 12. The scraper chain conveyor 12, which is a longwall conveyor, is not shown in FIGS. 1 and 3 for reasons of clarity.

The coal plough 10 is symmetrical about its transverse central plane, and comprises two similar a tension-proof manner by chain 15. The plough 10 is driven by an endless plough chain (not shown), the lower run 17 of which is guided in a chain passage formed behind the ramp guide 11. The plough chain is attached to the outer ends 16 of plough bodies 13 and 14. The two plough bodies 13 and 14 include, at each of their two opposite ends, detachable cutters 18 and 19 arranged in echelon formation. The plough bodies 13 and 14 are coupled by a rigid beam 20 which carries, at each end, detachable cutters 21 arranged one above the other. The beam 20 is connected to plough bodies 13 and 14 by downwardly depending supports 22 having horizontal slots 23. Bolts 24 pass through slots 23 to fix supports 22 to plough bodies 13 and 14. The elongate nature of slots 23 permits limited axial movement between beam 20 and plough bodies 13 and 14. This limited axial movement permits beam 20, and therefore the leading cutters 21 thereon, to be positioned behind the leading cutters 18 of plough bodies 13 and 14 in whichever direction plough 10 is driven. This largely avoids a hard, jerky start of plough 10, since cutters 21 on beam 20 start work only at a certain time after cutters 18 on plough bodies 13 and 14. The transmission of the plough drive forces does not take place through beam 20, but rather from the leading plough body 13 or 14, via chain 15, to the following plough body 14 or 13. The beam 20 is positioned high enough for a part of the coal won by the upper part of plough 10 to be loaded beneath beam 20 and onto conveyor 12.

In its central region, the beam 20 has an arm 25 which extends over conveyor 12. Arm 25 is supported and guided on a guide 26 arranged on the goaf side of conveyor 12.

Each plough body 13 and 14 has a plough upper part 27 mounted on beam 20. The two plough upper parts 27 are of like formation. Each has a carrier 28 having detachable cutters 29 arranged one above the other. Preferbly, cutters 29 are hinged cutter bits or the like. Each carrier 28 is pivotable in the vertical plane by means of a parallelogram linkage 30. Each linkage 30 comprises parallel links 31 and 32 which are connected to the respective carrier 28 by pivot joints 33, and to beam 20 by pivot joints 34. The joints 34 of each linkage 30 lie vertically one above the other approximately at the center of beam 20. A respective hydraulic ram 35 is associated with each linkage 30. Each ram 35 has a piston rod 37 which is attached to the bolt of the pivot joint 34 of the corresponding lower link 32. The cylinder of that ram 35 engages with the corresponding upper parallel link 31 by a pivot joint 36. Thus, each hydraulic ram 35 is arranged in an oblique position between respective parallel links 31 and 32, and is supported approximately centrally against beam 20. Joint 36 engages approximately at the center of the corresponding upper link 31.

Figure 4:
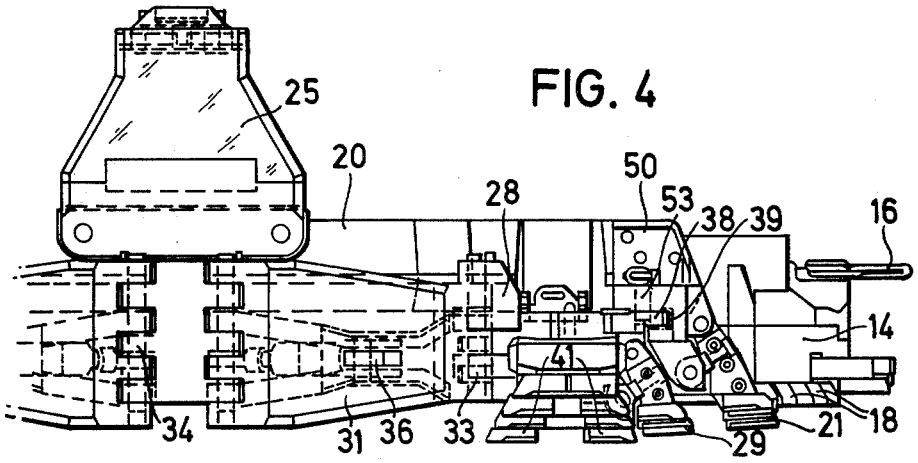
FIG. 4 is a partial plan view of the plough of FIGS. 1 to 3.

As shown best in FIG. 4, carriers 28 of the two plough upper parts 27 each have a fixed guide flange 38 on the goaf side. Each guide flange 38 is guided in a respective U-shaped guide 39 on beam 20. Each guide system 38 and 39 forms a positive keyed for the corresponding plough upper part 27, whereby that plough upper part is supported horizontally on both sides in every pivot position so that the reaction forces of the bodies 13 and 14, the elongate nature of the slots cutters 29 are transmitted through that keyed guide directly to beam 20.

Each plough upper part 27 has a vertically adjustable plough superstructure 40. The two plough superstructures 40 are of similar construction and each carries detachable cutters 41 which are arranged in echelon formation on a respective carrier 42. Each plough superstructure 40 is arranged for vertical movement on the corresponding plough upper part 27, by means of a ratchet adjustment device constituted by a sliding guide with a push-in locking bolt or the like. Each carrier 42 is mounted on the corresponding plough upper part 27 by means of a pivot joint 43. The cutters 41 of each carrier 42 are arranged one above the other on its two opposite ends so that cutting work can be carried out in the roof zone in both directions of travel of plough 10.

Figure 2:
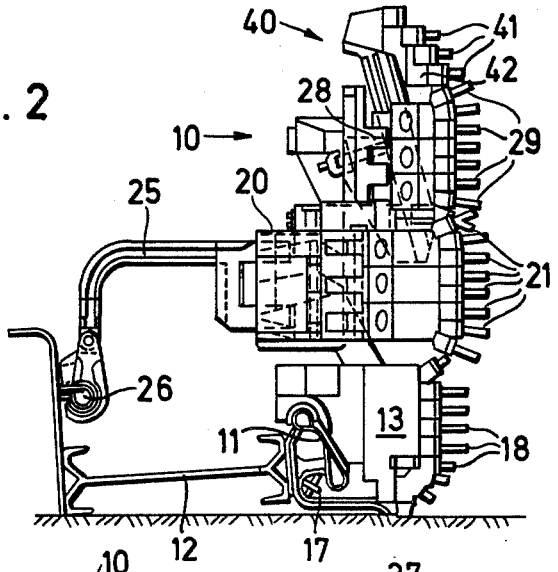
FIG. 2 is an end view of the plough of FIG. 1.
Figure 3:
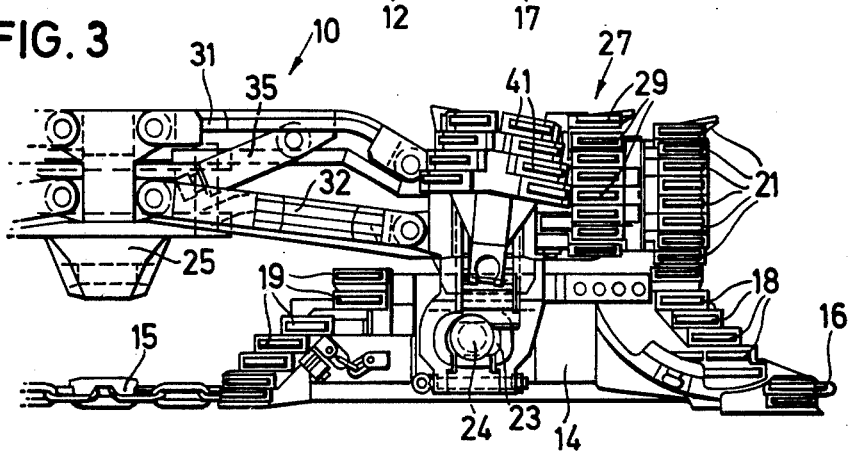
FIG. 3 is a partial side elevation corresponding to that of FIG. 1, in which the upper parts of the plough are shown in a lowered condition.

FIGS. 1 and 2 show plough 10 with plough upper parts 27 and superstructure parts 40 fully extended. It can be seen that cutter bits 18, 21, 29 and 41 are arranged one above the other so that even a thick seam can be won over its entire height by the cutter bits. FIG. 3, on the other hand, shows cutter bits 29 and 41 of plough upper parts 27 and of plough superstructures 40 in the lowered condition. In this case, cutter bits 29 of plough upper parts 27 are lowered to, or below, the cutting level of cutter bits 21 of beam 20, while cutter bits 41 of plough superstructures 40 are lowered to, or below, the cutting level of cutter bits 29 of plough upper parts 27. Thus, the cutting level of plough 10 can be adjusted within a wide range by adjustment of plough upper parts 27 and plough superstructures 40.

The hydraulic rams 35 are here interposed in space-saving manner between parallel lines 31 and 32, without occupying any space beneath beam 20. Covers, for example rubber mats or the like, can be provided to protect hydraulic rams 35. The actuation of hydraulic rams 35 can take place by means of small hand pumps or other hydraulic devices which are arranged in separate chambers 50 on the ends of beam 20.

Figure 5:
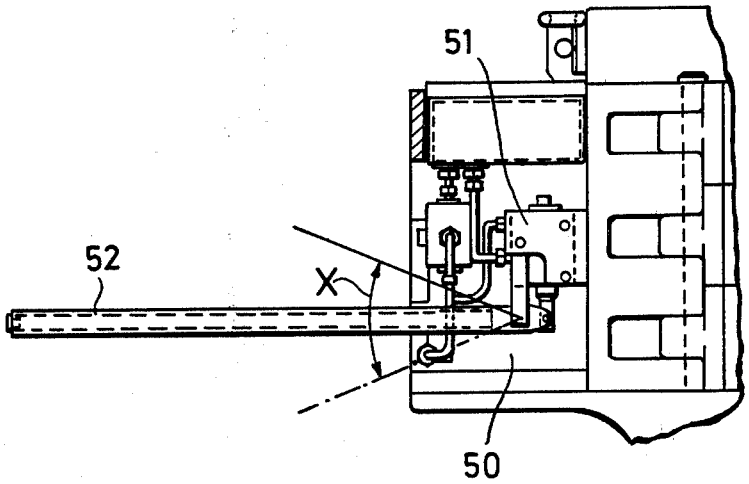
FIG. 5 is a partial view of a lever-actuated accumulator for the actuation of a hydraulic ram serving for the vertical pivoting of the upper part of the plough.

In FIG. 5, such a hydraulic device 52 is actuated by a hand lever 52. On pivoting of lever 52 in the direction of the arrow X, hydraulic fluid is fed through appropriate connection conduits (not shown) to the associated ram 35, the connection conduits being protected by beam 20. In order to relieve the hydraulic system during the winning work, the vertically pivotable plough upper parts 27 are locked to the keyed connections 38, 39 by detachable push-in bolts 53 which, as shown in FIG. 4, extend through bolt holes in guide flanges. 38 of plough upper parts 27.

It is also possible to provide a remotely controlled system for controlling the pivoting of the plough upper parts 27. Thus, plough 10 may have its own energy source, for example a battery, a compressed gas reservoir or the like, and the pivoting movements may be controlled by radio. Radio controlled locking devices may be remotely operated to lock the plough upper parts 27 and/or of the plough superstructure parts 40 in pace.

It is also important that plough upper parts 27 and plough superstructure parts 40 can be adjusted in height independently of one another. It is also possible to derive the energy for said adjustments from the drive to the plough itself. This can take place, for example, by a friction wheel drive which rolls on conveyor 12 and delivers its rotational energy to a hydraulic device such as a pressure convertor. The friction wheel drive in this case needs to be in operation only temporarily for the execution of the adjustment movements. The possibility also exists of taking the energy required for the adjustment of the plough upper and superstructure parts from the plough drive chain itself.

We claim:

1. A plough for winning material from a mineral face, wherein the plough includes two plough bodies connected together in a tension-proof manner, a beam connected to the two plough bodies at a pre-determined height, and linkage means to vertically pivot at least one plough upper part with respect to the beam, said plough further comprising:

(a) guide means for supporting each plough upper part on the beam, (b) said guide means including a substantially vertical guide flange and a mating slot for receiving each said guide flange, (c) each said vertical guide flange being located on a corresponding plough upper part, and (d) each said mating slot being formed in the beam.

2. A plough according to claim 1, wherein the linkage of each plough upper part is constituted by upper and lower parallel links each of which is pivotally connected to both that plough upper part and the beam by means of pivot joints.

3. A plough according to claim 2, wherein a respective hydraulic ram is arranged in an oblique position between the upper link of each linkage and the beam.

4. A plough according to claim 3, wherein the beam is provided with a hydraulically actuated device for supplying pressurized hydraulic fluid to each hydraulic ram.

5. A plough according to claim 4, wherein the hydraulically actuated device is provided with a remote control device.

6. A plough according to claim 5, wherein the remote control device is a radio controlled device.

7. A plough according to claim 3, wherein each hydraulic ram is supported on the beam in the vicinity of the pivot joint connecting the respective lower link to the beam, and approximately in the central region of the beam.

8. A plough according to claim 1, wherein each plough body is provided with detachable cutters at each end thereof.

9. A plough according to claim 1, wherein each plough upper part is provided with detachable cutters.

10. A plough according to claim 9, wherein each end of the beam is provided with detachable cutters.

11. A plough according to claim 10, wherein the linkage of each plough upper part is such that the cutters of that plough upper part can be pivoted so as to lie above the cutters provided on the beam.

12. A plough according to claim 10, wherein the linkage of each plough upper part is such that the cutters of that plough upper part can be pivoted so as to lie substantially at the same level as the cutters provided on the beam.

13. A plough according to claim 9, wherein each plough upper part is provided with a further plough superstructure which is vertically adjustable relative to that plough upper part.

14. A plough according to claim 13, wherein each further plough superstructure is provided with detachable cutters.

15. A plough according to claim 14, wherein each further plough superstructure is vertically adjustable so that its cutters lie substantially at the same level as the cutters of the corresponding plough upper part.

16. A plough according to claim 9, wherein the cutters of each plough upper part are pivotally mounted thereon.

17. A plough according to claim 1, wherein each plough upper part includes a further plough superstructure which is vertically adjustable relative to that plough upper part.

18. A plough according to claim 17, wherein each further plough superstructure is vertically adjustable relative to its plough upper part by means of a ratchet adjustment device.

19. A plough according to claim 17, wherein each further plough superstructure is provided with a locking device for locking that further plough superstructure at a predetermined height relative to the corresponding plough upper part.

20. A plough according to claim 17, wherein each further plough superstructure is pivotably mounted on the corresponding plough upper part.

21. A plough according to claim 19, wherein the locking device of each further plough superstructure is constituted by a respective push-in bolt.

22. A plough according to claim 1, wherein each end of the beam is provided with detachable cutters.

23. A plough according to claim 1 wherein each guide means includes a locking device for locking the respective plough upper part at a predetermined height with respect to the beam.

24. A plough according to claim 23, wherein the locking device of each plough upper part comprises a respective push-in bolt which extends through the vertical guide flange.

25. A plough according to claim 1, wherein the beam is connected to the two plough bodies so as to be capable of limited axial movement relative thereto.

26. A plough according to claim 25, wherein the beam is connected to each plough body by a respective downwardly depending flange having an elongate slot, each flange being fixed to its plough body by means of a bolt passing through its elongate slot.

27. A plough according to claim 1, wherein each end of the beam has a respective plough upper part which is vertically pivotable relative thereto by means of a respective linkage, and the two plough upper parts are vertically pivotable independently of one another.

28. A plough according to claim 1, wherein the plough is provided with its own energy source for powering the pivotal movement of each plough upper part.

29. A plough according to claim 1, wherein each plough upper part is pivotable, via a friction wheel drive, from the drive system provided for driving the plough along the mineral face.

30. In a plough for winning material from a mineral face, the plough comprising two plough bodies connected together in a tension-proof manner, and a beam connected to the two plough bodies at a pre-determined height, the beam including a plough upper part at each end thereof, and each plough upper part being vertically pivotable relative to the beam by means of a parallelogram linkage, the improvement comprising:

(a) guide means defining a keyed connection for guiding and supporting each plough upper part on the beam (b) said guide means including a substantially vertical key on the corresponding plough upper part and a mating slot for receiving each key being formed in the beam, (c) said two plough upper parts being independently vertically adjustable.

31. A plough for winning material from a mineral face, wherein the plough includes two plough bodies connected together in a tension-proof manner, a beam connected to the two plough bodies at a pre-determined height, and linkage means to vertically pivot at least one plough upper part with respect to the beam, said plough further comprising:

(a) guide means defining a keyed connection for supporting each plough upper part on the beam, (b) said linkage of each plough upper part including upper and lower parallel links, each of which is pivotally connected at one end thereof to a plow upper part and at the other end thereof to the beam.

32. A plough according to claim 31, wherein said guide means includes a substantially vertical guide flange and a mating slot for receiving each said guide flange, each said vertical guide flange being located on a corresponding plough upper part, and each said mating slot being formed in the beam.

33. A plough according to claim 32, wherein a respective hydraulic ram is arranged in an oblique position between the upper link of each linkage and the beam.

34. A plough according to claim 31, wherein the beam is connected to the two plough bodies so as to be capable of limited axial movement relative thereto.

35. A plough according to claim 34, wherein the beam is connected to each plough body by a respective downwardly depending flange having an elongate slot, each flange being fixed to its plough body by means of a bolt passing through its elongate slot.

* * * * *